US009548554B2

(12) United States Patent
Yoshikawa et al.

(10) Patent No.: US 9,548,554 B2
(45) **Date of Patent: *Jan. 17, 2017**

(54) CONDUCTIVE TERMINAL HAVING A PERIPHERAL OPEN PORTION BETWEEN A FRAME MEMBER AND A CONTACT MEMBER

(71) Applicant: Molex, LLC, Lisle, IL (US)

(72) Inventors: Naoto Yoshikawa, Yamato (JP); Masanori Hayashi, Sagamihara (JP); Yasuyoshi Matsumoto, Yamato (JP); Yuki Goto, Yamato (JP); Mitsuhiro Tomita, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/047,282

(22) Filed: Feb. 18, 2016

(65) Prior Publication Data

US 2016/0226174 A1 Aug. 4, 2016

Related U.S. Application Data

(63) Continuation of application No. 13/959,871, filed on Aug. 6, 2013, now Pat. No. 9,300,070.

(30) Foreign Application Priority Data

Aug. 7, 2012 (JP) ..... 2012-175275

(51) Int. Cl.
*H01R 13/24* (2006.01)
*H01R 24/00* (2011.01)
(Continued)

(52) U.S. Cl.
CPC ..... *H01R 13/245* (2013.01); *H01R 4/023* (2013.01); *H01R 12/714* (2013.01); *H01R 13/24* (2013.01); *H01R 24/00* (2013.01)

(58) Field of Classification Search
CPC ... H01R 13/24; H01R 13/2457; H01R 12/714; H01R 14/2464; H01R 14/2494; H01R 14/24575
(Continued)

(56) References Cited

U.S. PATENT DOCUMENTS 7,086,904 B1 8/2006 Kuan et al.
7,371,079 B2 5/2008 Yang et al.
(Continued)

FOREIGN PATENT DOCUMENTS

CN 201274338 Y 7/2009
CN 201323260 Y 10/2009
(Continued)

*Primary Examiner* — Abdullah Riyami
*Assistant Examiner* — Harshad Patel
(74) *Attorney, Agent, or Firm* — James A. O'Malley

(57) ABSTRACT

The connector for a card has a housing for accommodating a card provided with terminal members, and connecting terminals mounted in the housing and contacting the terminal members of the card. Here, at least one of the connecting terminals has a base portion provided along a rear edge of the housing, at least some of the base portion is embedded in a bottom wall portion of the housing, and a contact member forming a hoop along with the base portion. The contact member has a pair of spring portions connected to the base portion, a joining portion joining the pair of spring portions, and a contact portion connected to the leading end of the joining portion for contacting the terminal members of the card.

11 Claims, 12 Drawing Sheets

(51) Int. Cl.
*H01R 12/71* (2011.01)
*H01R 4/02* (2006.01)

(58) Field of Classification Search
USPC ..... 439/874, 862, 66, 81, 82, 83, 91, 247,439/591
See application file for complete search history.

(56) References Cited

U.S. PATENT DOCUMENTS

| | | | | |
|---|---|---|---|---|
| 7,435,117 | B2 | 10/2008 | Ma | |
| 7,442,087 | B2 | 10/2008 | Long et al. | |
| 7,575,479 | B2 | 8/2009 | Hung et al. | |
| 7,635,276 | B1 | 12/2009 | Chu et al. | |
| 7,654,868 | B1 | 2/2010 | Wang et al. | |
| 7,955,135 | B2 * | 6/2011 | Wang ..... | H01R 12/57 439/630 |
| 7,967,640 | B2 | 6/2011 | Hashimoto et al. | |
| 8,079,876 | B2 | 12/2011 | Wang et al. | |
| 8,821,191 | B2 | 9/2014 | Soo | |
| 8,864,524 | B2 | 10/2014 | Sato | |
| 2005/0130499 | A1 | 6/2005 | Zheng et al. | |
| 2006/0040560 | A1 | 2/2006 | Uchida et al. | |
| 2006/0289644 | A1 | 12/2006 | Hopt et al. | |

FOREIGN PATENT DOCUMENTS

| | | |
|---|---|---|
| JP | 2009-295351 | 12/2009 |
| JP | 2010-135137 A | 6/2010 |
| JP | 2011-165560 A | 8/2011 |
| WO | WO 2012/076396 A1 | 6/2012 |

* cited by examiner

CONDUCTIVE TERMINAL HAVING A PERIPHERAL OPEN PORTION BETWEEN A FRAME MEMBER AND A CONTACT MEMBER

REFERENCE TO RELATED APPLICATIONS

This Application is a continuation and claims priority to U.S. application Ser. No. 13/959,871, filed Aug. 6, 2013, which in turn claims priority to Japanese Application No. 2012-175275, filed Aug. 7, 2012, both of which are incorporated herein by reference in their entirety.

BACKGROUND OF THE PRESENT DISCLOSURE

The Present Disclosure relates, generally, to a connector for a card.

Conventional electronic devices typically include card connectors to allow various types of memory cards to be used. An example of such a conventional electronic device is disclosed in Japanese Patent Application No. 2008-146289, the content of which is incorporated in its entirety herein.

FIG. 12 is a diagram showing a conventional connector for a card. In this drawing, 811 is the metal frame of the card connector, which has a bottom plate portion 811*b*, and which accommodates a memory card (not shown). The electrode pads (not shown) of a memory card, such as a SIM card, are exposed on the bottom.

A plurality of first terminal holding portions 811*c* and second terminal holding portions 811*d* are formed in the bottom plate portion 811*b*, and metal first terminals 851 and second terminals 861 are held in each first terminal holding portion 811*c* and second terminal holding portion 811*d*. In the example shown, the first terminals 851 and second terminals 861 are arranged in two rows to accommodate the arrangement of electrodes in a SIM card.

The first terminal 851 includes a rectangular frame portion 851*a* open in the center, a cantilevered contact member 851*b* having a base end connected to the inner edge of the short side of the rectangular frame portion 81*a* and extending into the opening, and a tail portion 851*d* extending outward from the outer edge of the short side of the rectangular frame portion 851*a*. The second terminal 861 includes a rectangular frame portion 861*a* open in the center, a cantilevered contact member 861*b* having a base end connected to the inner edge of the short side of the rectangular frame portion 861*a* and extending into the opening, and a tail portion 861*d* extending outward from the outer edge of the short side of the rectangular frame portion 861*a*.

The first terminal 851 and the second terminal 861 are secured to the bottom plate portion 811*b* by bonding the frame portions 851*a*, 861*a*, coated with an insulating film, to the first terminal holding portion 811*c* and second terminal holding portion 811*d* using an insulating adhesive. Also, the first terminal 851 and the second terminal 861 are connected electrically to the conductive traces of the circuit board (not shown) by soldering the tail portions 851*d*, 861*d* to the connection pads on the surface of the circuit board. The frame 811 is then secured to the surface of the circuit board by soldering the tail portions 851*d*, 861*d* to connection pads.

When a memory card is loaded into the frame 811, the electrode pads exposed on the bottom face of the memory card come into electrical contact with the contact members 851*b*, 861*b* of the first terminal 851 and the second terminal 861. Because the cantilevered contact members 851*b*, 861*b* are elastically deformed, and the resulting spring action presses them against the electrode pads, contact with the electrode pads can be reliably maintained.

Conventional card connectors, unfortunately, are difficult to use because cards such as memory cards can be difficult to insert and eject. Card connectors with push/push card guiding mechanisms have been introduced in which the card is pushed in when it is loaded and pushed in when removed in order to make it easier for a user to load or remove a card with one hand.

Further, electronic devices and cards become smaller and more compact with each passing year, meaning the area of the card surface occupied by electrode pads increases, and the leeway to arrange the electrode pads a certain way decreases. For example, a SIM card is a card with two rows of electrode pads, and the electrode pads in the front row and back row are arranged near the front and rear edges of the card. Because a card is pushed into the insertion slot of a card connector with a push/push card guiding mechanism, the leading end of the contact members of the terminals corresponding to the electrode pads arranged near the rear edge of the card has to be arranged near the insertion slot at the rear end of the card connector.

When the terminals are mounted to place the leading end portion as close as possible to the insertion slot and to extend the spring-loaded cantilevered contact member upwards at an angle from the interior of the card connector towards the insertion slot, the contact members of the terminals may buckle. When the terminals are mounted to extend cantilevered contact members upward at an angle from the insertion slot of the card connector towards the inside, the contact members do not buckle. However, when the length of the contact members is reduced in this configuration to move the contact portions at the leading end of the contact members closer to the insertion slot, the length of the spring is reduced and contact between the leading end and electrode pads of the card becomes less reliable.

SUMMARY OF THE PRESENT DISCLOSURE

A purpose of the Present Disclosure is to solve the aforementioned problems associated with conventional connectors for cards by providing a connector for a card in which a contact portion can be arranged at the leading edge of a contact member in a position near the rear edge of a housing while maintaining sufficient spring length in a connecting terminal. Doing so will allow a card with terminal members arranged on the rear end to be easily inserted and ejected, improving reliability.

In the Present Disclosure, the connector for a card has a housing for accommodating a card provided with terminal members, and connecting terminals mounted in the housing and contacting the terminal members of the card. Here, at least one of the connecting terminals has a base portion provided along a rear edge of the housing, at least some of the base portion is embedded in a bottom wall portion of the housing, and a contact member forming a hoop along with the base portion. The contact member has a pair of spring portions connected to the base portion, a joining portion joining the pair of spring portions, and a contact portion connected to the leading end of the joining portion for contacting the terminal members of the card.

In another connector for a card according to the Present Disclosure, the contact member has an M-shaped or W-shaped profile when viewed from above. In another connector, the leading end of the joining portion extends at an angle towards the front edge of the housing, and the contact portion is positioned inside the open portion of the hoop when viewed from above. In yet another connector, each spring portion includes a first portion extending from the base portion towards the rear edge of the housing, a curved second portion having an end connected to the first portion, and a third portion connected to the other end of the second portion and extending towards the front edge of the housing. Here, the leading end of the third portion being joined to the joining portion. In still another connector for a card, each spring portion has a fixed width and thickness along its entire length, and functions as a cantilevered spring plate. In a further connector for a card, the housing is provided along the rear edge and has a terminal holding recessed portion passing through the bottom wall portion, and the connecting terminal provided along the rear edge of the housing is held inside the terminal holding recessed portion so the contact member does not make contact with the bottom wall portion.

The Present Disclosure provides a connector for a card in which a contact portion can be arranged at the leading edge of a contact member in a position near the rear edge of a housing, while maintaining sufficient spring length in a connecting terminal, thereby allowing a card with terminal members arranged on the rear end to be easily inserted and ejected, improving reliability.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIGS. 4A, 4B and 4C are perspective views of a card to be inserted into the connector of FIG. 1, in which FIG. 4A is a top view, FIG. 4B is an angular view from above and FIG. 4C is an angular view from below;

FIGS. 5A, 5B and 5C illustrate the terminals according to the first embodiment of the Present Disclosure, in which FIG. 5A is an angular view from above and the rear, FIG. 5B is an angular view from above and the front and FIG. 5C is an angular view from below and the front;

FIGS. 6A, 6B and 6C illustrate the terminals according to the first embodiment of the Present Disclosure, in which FIG. 6A is a top view, FIG. 6B is a view from the side without a card loaded and FIG. 6C is a view from the side with a card loaded;

FIGS. 7A, 7B and 7C illustrate the contact member of the terminals of FIGS. 5A, 5B and 5C, in which FIG. 7A is an angular view from above and the rear, FIG. 7B is an angular view from above and the front and FIG. 7C is an angular view from below and the front;

FIGS. 8A, 8B and 8C illustrate the contact member of the terminals of FIGS. 5A, 5B and 5C, in which FIG. 8A is a top view, FIG. 8B is a view from the side without a card loaded and FIG. 8C is a view from the side with a card loaded;

FIGS. 10A, 10B and 10C illustrate the terminals according to a second embodiment of the Present Disclosure, in which FIG. 10A is an angular view from above and the rear, FIG. 10B is an angular view from above and the front and FIG. 10C is an angular view from below and the front;

FIGS. 11A, 11B and 11C illustrate the terminals of FIGS. 10A, 10B and 10C, in which FIG. 11A is a top view, FIG. 11B is a view from the side without a card loaded, and FIG. 11C is a view from the side with a card loaded.

DESCRIPTION OF THE PREFERRED EMBODIMENTS

Figure 1:
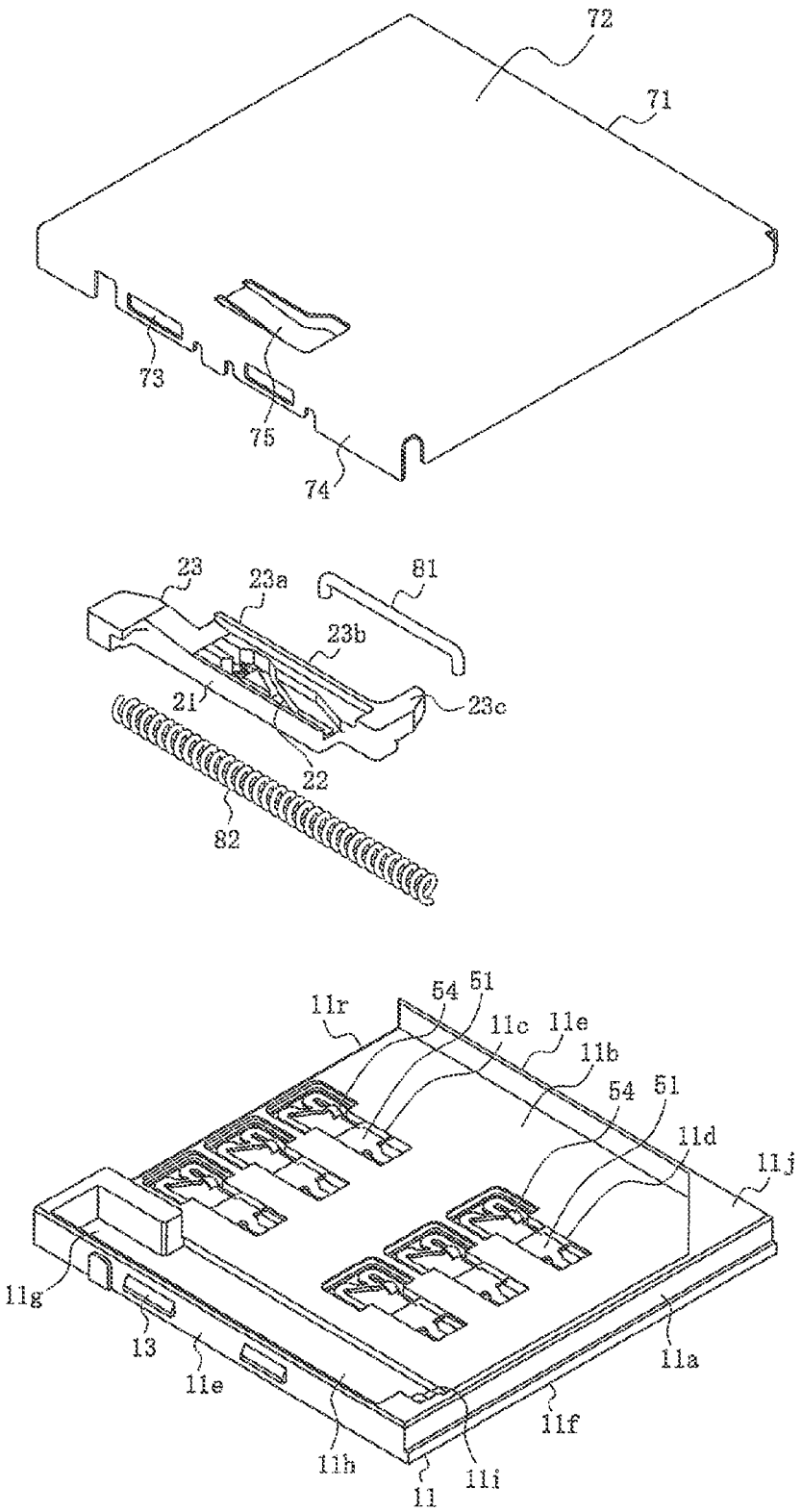
FIG. 1 is an exploded view of a connector for a card according to a first embodiment of the Present Disclosure.

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Referring to the Figures, generally, and, in particular, FIGS. 1, 2, 3, 4A, 4B and 4C, 101 is the card according to the present embodiment, which is inserted into a card connector 1 (described below) mounted in an electronic device (not shown). In other words, the card 101 is mounted in the electronic device via the card connector 1. In the present embodiment, the card 101 has a rectangular shape, and contact pads 151 serving as the electrode pads or contact members are arranged along the front end 111*f* in the portion of the bottom face 111*a* near the front end 111*f*. Contact pads 151 are also arranged along the rear end 111*r* in the portion of the bottom face 111*a* near the rear end 111*r*. In other words, the contact pads 151 are arranged in two rows extending in the width direction of the card 101. Contact pads 151 are not provided in the top face 111*b*. A notched portion 111*c*, which is notched at an angle, is formed in the front left corner of the top face 111*b*, which is the corner connecting the left edge of the front end 111*f* to the side edge 112.

The card connector 1 has a housing 11, integrally molded from an insulating material resin, and a shell 71, serving as a cover member integrally formed by punching and then bending a plate made of a conductive material and mounting it on the upper side of the housing 11. The shell 71 covers at least some of the upper portion of the housing 11 and the card 101 inserted in the housing 11. The card connector 1, which has a substantially flat and rectangular shape, is mounted in the electronic device. A card 101 is inserted into the housing 11 from the insertion slot 18 on the rear (on the upper left in FIG. 2). More specifically, the card 101 is inserted into a space formed by the housing 11 and the shell 71. The shell 71 can be omitted, and the housing 11 can have a cylindrical shape with a cover member formed partially of metal and partially of resin.

As shown, the housing 11 has a flat, rectangular bottom wall portion 11*b*, and an edge portion at the front of the housing 11 in the insertion direction of the card 101. That is, an inner wall portion 11*a* extending along the front edge 11*f* and standing erect from the bottom wall portion 11*b*, and side wall portions 11*e* extending in the longitudinal direction along the left and right edges of the bottom wall portion 11*b*.

Here, the bottom wall portion 11*b* has rear terminal holding recessed portions 11*c*, which are the terminal holding recessed portions for holding the connection terminals 51 to the rear of the other connection terminals, and front terminal holding recessed portions 11*d*, which are the terminal holding recessed portions for holding the connection terminals 51 in front of the other connection terminals. The rear terminal holding recessed portions 11*c* are openings passing through the bottom wall portion 11*b* in the thickness direction, and are arranged along the rear edge of the housing 11 in the insertion direction of the card 101. In other words, they form a row extending along the rear edge 11*r* in the width direction of the housing 11. A terminal 51 is accommodated and held inside each rear terminal holding recessed portion 11*c*. The front terminal holding recessed portions 11*d* are openings passing through the bottom wall portion 11*b* in the thickness direction, and are arranged along the front edge of the housing 11 in the insertion direction of the card 101. In other words, they form a row extending between the front edge 11*f* and the rear edge 11*r* in the width direction of the housing 11. A terminal 51 is accommodated and held inside each front terminal holding recessed portion 11*d*.

At least some of the base portion 52 of the terminal 51 is embedded in the bottom wall portion 11*b*, and another portion is exposed inside the rear terminal holding recessed portion 11*c* and the front terminal holding recessed portion 11*d*. More specifically, the terminal 51 is embedded and held in the base wall portion 11*b* by over molding.

Figure 3:
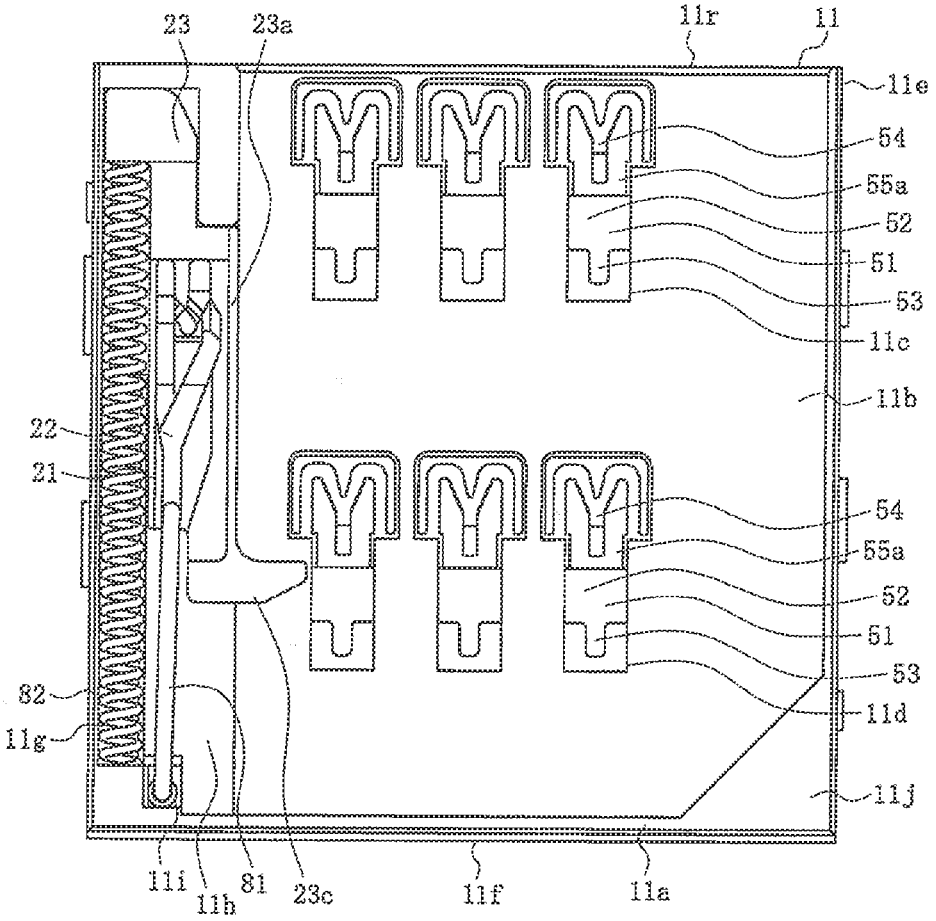
FIG. 3 is a top view of the connector of FIG. 1, in which the shell has been removed.
Figures 4A, 4B, 4C:
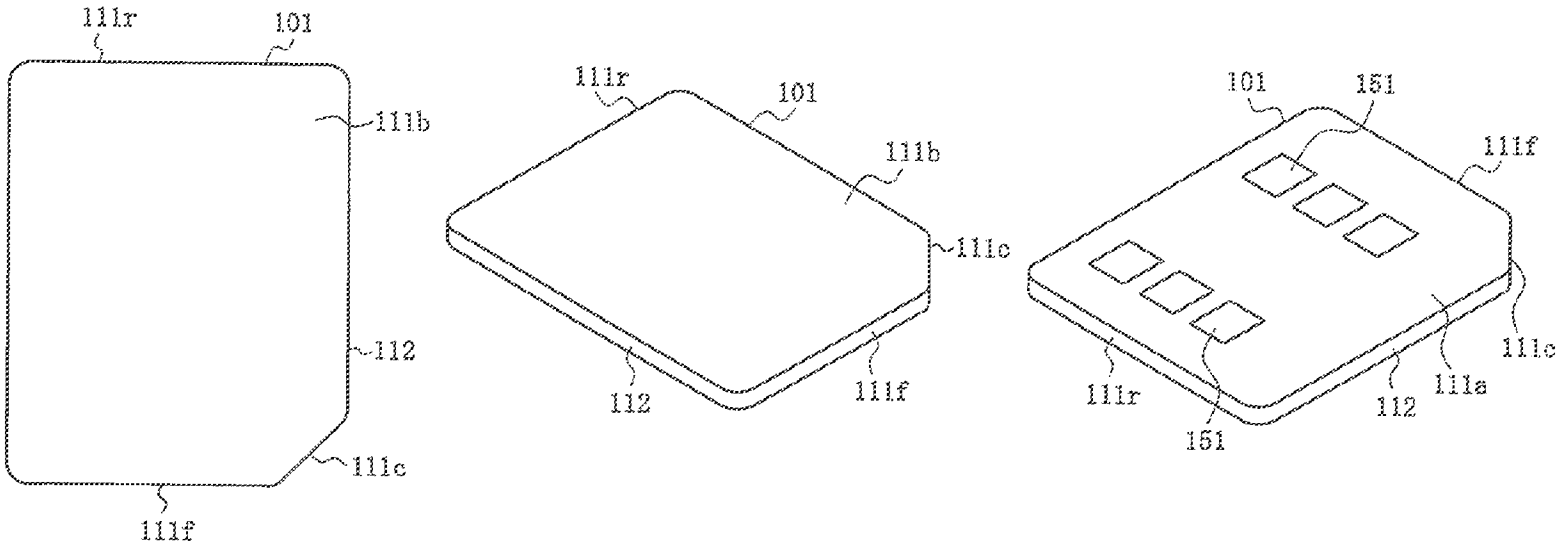
Figure 5A:
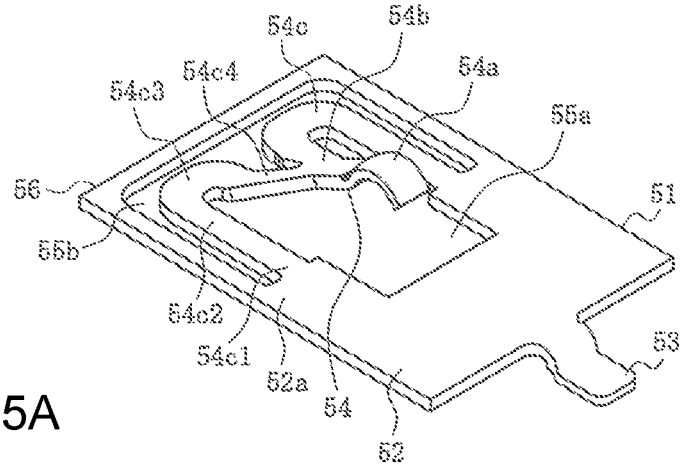
Figure 5B:
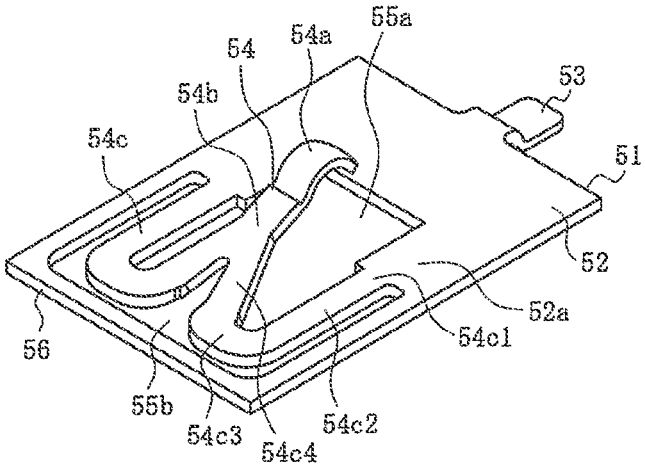
Figure 5C:
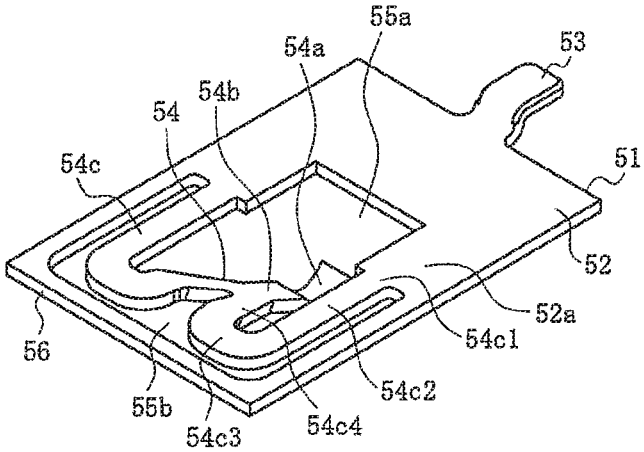

The terminal 51 has an elastically deformable contact portion 54 whose base is connected to the base portion 52, and a solder tail portion 53 protruding from the base portion 52. Also, a central opening 55*a* is formed between the base portion 52 and the contact member 54. The leading end of the contact member 54 extends upward at an angle towards the front edge 11*f*, and at least the top face of the leading end is positioned above the top face of the bottom wall portion 11*b* when a card 101 is not inserted into the card insertion space. As shown in FIG. 3, the contact member 54 and the solder tail portion 53 are positioned inside the rear terminal holding recessed portion 11*c* and the front terminal holding recessed portion 11*d* when viewed from above. The solder tail portion 53 functions as a solder connector, and is connected electrically to a signal line, contact pad or other terminal member formed in the circuit board of the electronic device. At least some of the contact member 54 of each terminal 51 contacts each contact pad 151 of a card 101 held inside the card connector 1. Accordingly, the number, layout and shape of the terminals 51 depend on the number, layout and shape of the contact pads 151 on the card 101.

A card guiding mechanism accommodating portion 11*h* and a biasing member accommodating portion 11*g* are formed inside a side wall portion 11*e* of the housing 11 (the left side in FIG. 3). The sliding member 23 for the card guiding mechanism used to guide an inserted card 101 into the card connector 1 is slidably mounted in the longitudinal direction in the card guiding mechanism accommodating portion 11*h*. The sliding member 23 has a sliding cam portion 21. The sliding cam portion 21 is a member functioning as a sliding cam inside a heart-shaped cam mechanism used to operate the push/push operation. A cam groove 22 is formed in the upper surface. The other end of the cam groove 22 engages one end of a slender pin member 81 serving as a cam member for engaging a pin engaging portion 11*i* of the housing 11.

A biasing member 82 or coil spring for providing biasing force when compressed is accommodated inside the biasing member accommodating portion 11*g*. The rear end surface of the sliding cam portion 21 functions as the biasing force receiving portion for receiving the biasing force of the biasing member 82. The sliding member 23 is thus biased by the biasing member 82 in the direction opposite the insertion direction of the card 101 (that is, in the ejection direction of the card 101). Also, the slide member 23 has a card holding portion 23*a* for holding the card 101. The card holding portion 23*a* has a slender, band-shaped side edge holding portion 23*b* extending towards the front, and a slender, band-shaped front end holding portion 23*c* connected to the leading end of the side edge holding portion 23*b* and extending in the width direction of the housing 11. The sliding member 23 holds the card 101 by the side edge holding portion 23*b* and the front end holding portion 23*c* of the card holding portion 23*a*, and moves in the longitudinal direction along with the card 101.

The card 101 has to be pushed into a card connector 1 with a card guiding mechanism when the card 101 is inserted into the card connector 1 and when the card 101 is ejected from the card connector 101. This operation is referred to as a push/push operation or a push-in/push-out operation. The operation is similar to the alternating operation of a push button (position-holding button or push-on/push-off button). The push/push operation is performed by the pin member 81 and cam groove 22 on the sliding member 23 moving with the card 101. When the card 101 has been pushed in the insertion direction in the card guiding mechanism and the card 101 has been moved to the end point in the insertion direction, the biasing action of the biasing member 82 can move the card 101 from the end point in the opposite direction to eject the card. The sliding member 23 also stops in the locked position to hold the card 101 inside the card connector 1.

The pin member 81 is held down by the biasing action of the pin pushing member 75 of the shell 71. The pin pushing member 75 is a plate-shaped portion of the shell 71 which has been bent in the direction of the bottom wall portion 11*b* of the housing 11 to provide spring action. The pin member 81 is positioned between the pin pushing member 75 and the sliding member 23 or housing 11, and is held so as not to separate from the sliding member 23 or housing 11.

Figure 2:
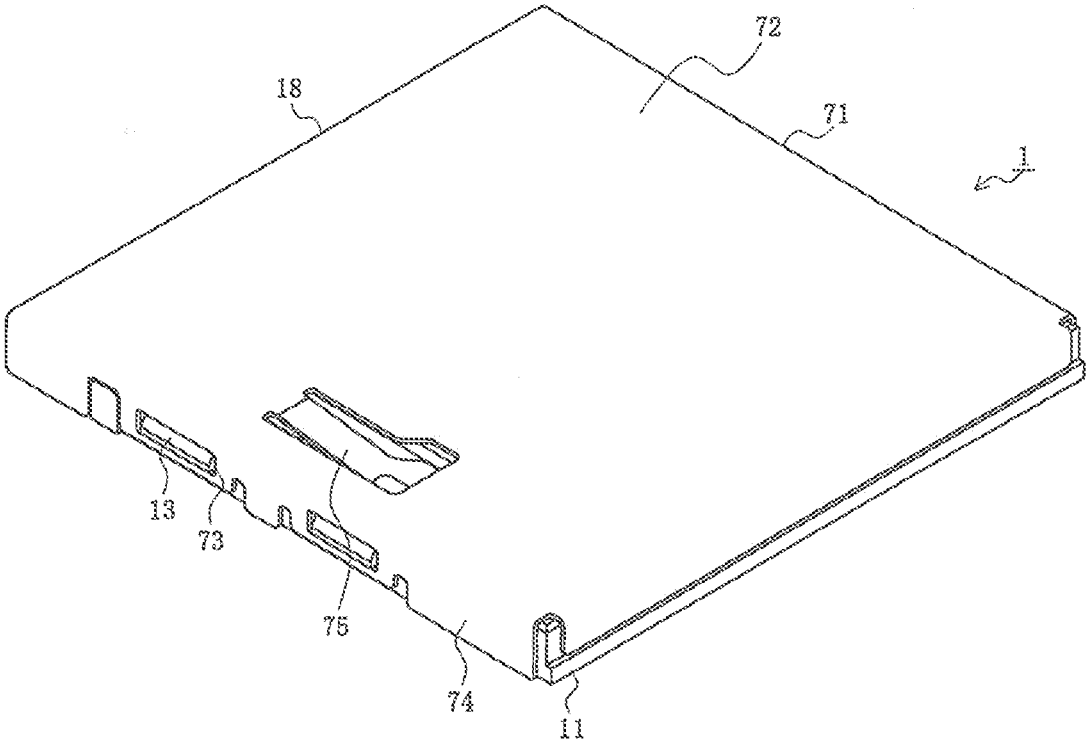
FIG. 2 is a perspective view of the connector of FIG. 1.

The shell 71 also has a rectangular ceiling plate portion 72 and a plurality of side plate portions 74 standing erect from the side edge of the ceiling plate portion 72 in several locations. Several engaging openings 73 are formed in the side plate portion 74. When, as shown in FIG. 2, the shell 71 is mounted on the upper end of the housing 11, the engaging openings 73 engage engaging protrusions 13 formed in an outer surface of the housing 11 such as the side wall portion 11*e*, and this secures the shell 71 to the housing 11.

A faulty insertion preventing portion 11*j* with an inclined surface set at an angle with respect to the side wall portion 11*e* and the inner wall portion 11*a* is formed in the inner wall portion 11*a* and other side wall portion 11*e* of the housing 11 (on the right in FIG. 3). When the card 101 is arranged properly; that is, when the card 101 has been inserted into the card connector 1 so that the bottom face 111*a* faces the bottom wall portion 11*b* and the front end 111*f* faces the inner wall portion 11*a*, the notched portion 111*c* is fitted into the faulty insertion preventing portion 11*j*, and the inserted card 101 can reach the end point. When the card 101 is arranged improperly; that is, when the card 101 has been inserted into the card connector 1 improperly, a corner of the card 101 without the notched portion 111*c* abuts the faulty insertion preventing portion 11*j*, and the inserted card 101 cannot reach the end point, preventing faulty insertion.

FIGS. 5A-5C, 6A-6C, 7A-7C, 8A-8C and 9 illustrate the terminals 51, which are integrally formed with the shape shown in FIGS. 5A-5C and 6A-6C by punching and bending a plate made of a conductive material using a press device. The punching and bending can be performed simultaneously or successively. The terminals can be formed using any type of processing method. In FIGS. 7A-7C and 8A-8C, only the contact member 54 of the terminal 51 is shown. The other portions of the terminal 51 have been omitted.

Figure 6A:
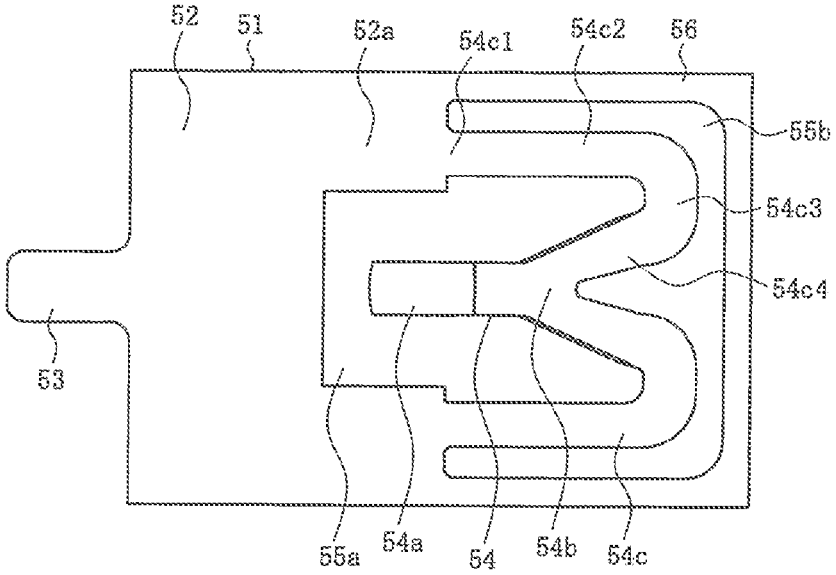

As shown in FIG. 6A, the terminal 51 is left-right symmetrical when viewed from above with respect to a center line (not shown) which extends in the longitudinal direction (left to right in FIG. 6A). The base portion 52 of the terminal 51 includes a pair of connecting portions 52*a* extending to the outside from the left and right sides on the rear edge (right edge in FIG. 6A), creating a U shape when viewed from above. The contact member 54 of the terminal 51, when viewed from above, also forms a hoop with the base portion 52, creating a central opening 55*a* in the space closed off by the circumferential edges of the hoop. In other words, the contact member 54 is a hoop surrounding a central opening 55*a*.

More specifically, the contact member 54 has an M- or a W-shape, and is connected to the connecting portion 52*a* of the base portion 52. Even more specifically, the contact member 54 has a pair of left and right arm portions 54*c* which are U- or J-shaped when viewed from above, a joining portion 54*b* joining the left and right arm portions 54*c*, and a contact portion 54*a* connected to the leading end, or the free end, of the joining portion 54*b*. Each arm portion 54*c* includes a root portion 54*c*1 connected to the connecting portion 52*a* of the base portion 52, an upper arm portion 54*c*2 or first portion extending linearly to the rear from the root portion 54*c*1, a curved portion 54*c*3 or second portion connected on one end to the rear end of the upper arm portion 54*c*2 and curving from the rear towards the front, and a front arm portion 54*c*4 or third portion connected to the other end of the curved portion 54*c*3 and extending linearly towards the front or towards the front at an angle. The front end of the front arm portion 54*c*4 of the left and right arm portions 54*c* are joined and integrated with the joining portion 54*b*.

The leading ends of the front arm portion 54*c*4 and the joining portion 54*b* extend upward and at an angle towards the front (to the left in FIG. 6A), and at least the top face of the contact portion 54*a* is positioned above the top face of the bottom wall portion 11*b* when a card 101 has not been inserted in the card connector 1. The leading end of the contact portion 54*a* faces downward at an angle and has a side surface curving or protruding upward.

The terminal 51 in the present embodiment also has a frame member 56 surrounding the contact member 54. The frame member 56 is U-shaped when viewed from above, and is connected to the connecting portion 52*a* of the base portion 52. The profile of the connected base portion 52 and frame member 56 is rectangular when viewed from above. A peripheral open portion 55*b* is formed between the frame member 56 and the contact member 54. A central opening 55*a* is formed between the base portion 52 and the contact member 54. In this explanation, the central opening 55*a* and the peripheral open portion 55*b* are integrally referred to as opening 55.

Figure 6B:
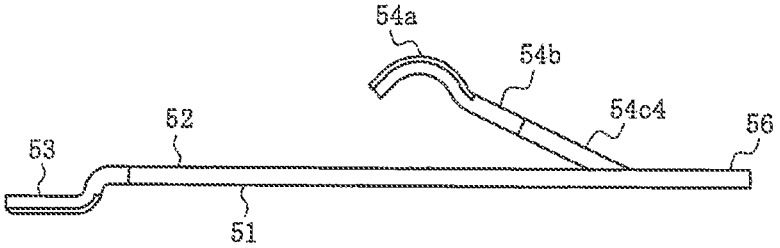

A solder tail portion 53 protrudes from the center of the front edge of the base portion 52 (the left edge in FIG. 6A). The solder tail portion 53 is connected to the base portion 52 via a curved portion and, as shown in FIG. 6B, is positioned below the base portion 52. In this way, at least the bottom face of the solder tail portion 53 is positioned below the bottom face of the bottom wall portion 11*b* when some of the base portion 52 is embedded on the bottom wall portion 11*b* of the housing 11, and the solder tail portion 53 can connect to another terminal member formed in a circuit board facing the bottom face of the bottom wall portion 11*b*.

As mentioned earlier, some of the base portion 52 is covered in the insulating material forming the bottom wall portion 11*b* and the terminal 51 is embedded in the base wall portion 11*b*. In the example shown in FIG. 3, the left and right sides of the base portion 52 including the connecting portion 52*a* and most of the frame member 56 are embedded in the bottom wall portion 11*b*. The central portion of the base portion 52, all of the solder tail portion 523, and all of the contact member 54 are not embedded in the bottom wall portion 11*b*, and the interior of the rear terminal holding recessed portion 11*c* and the front terminal holding recessed portion 11*d* are exposed. Because the terminal 51 is embedded in the bottom wall portion 11*b* on the periphery, it is held securely.

Because the interior of the rear terminal holding recessed portion 11*c* and the front terminal holding recessed portion 11*d* is entirely exposed and positioned inside the opening 55, the contact member 54 is not constrained or interfered with by other components such as the bottom wall portion 11*b* and the frame member 56 when it is elastically deformed in a vertical direction. At least the top face of the contact portion 54*a* of the contact member 54 is positioned above the top face of the bottom wall portion 11*b* when a card 101 is not inserted into the card insertion space.

Figure 8A:
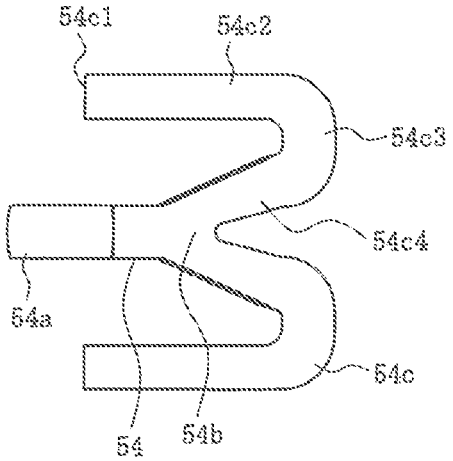
Figure 8B:
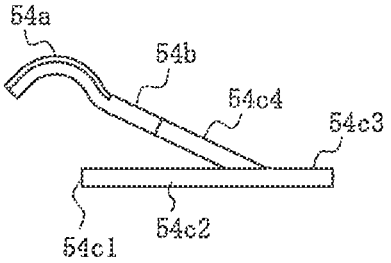
Figure 9:
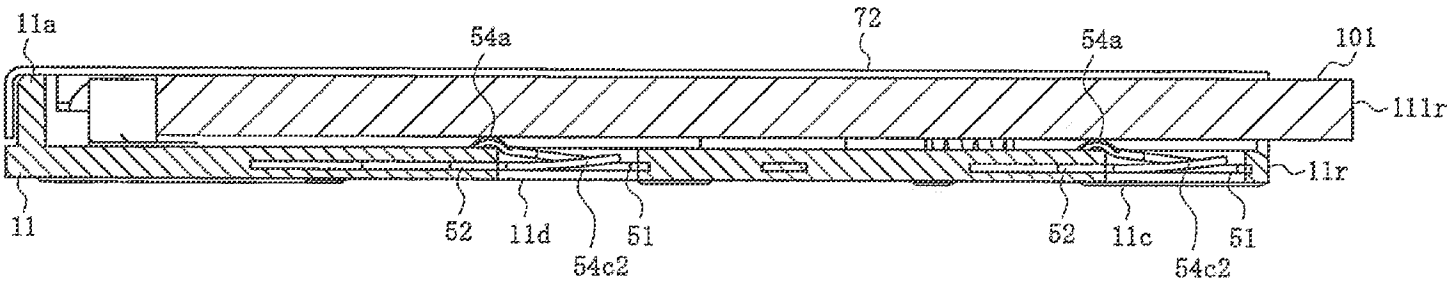
FIG. 9 is a cross-sectional side view of a card loaded in the connector of FIG. 1.
Figure 10A:
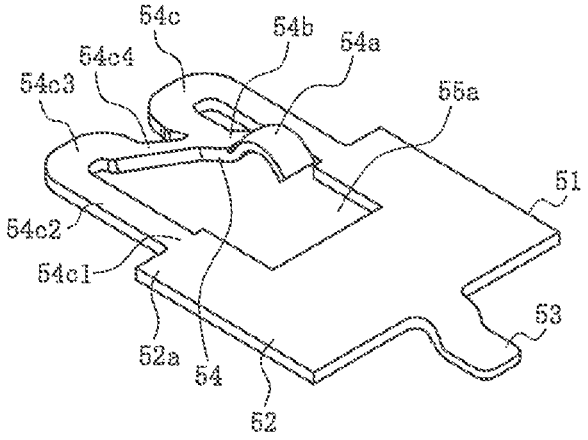
Figure 10B:
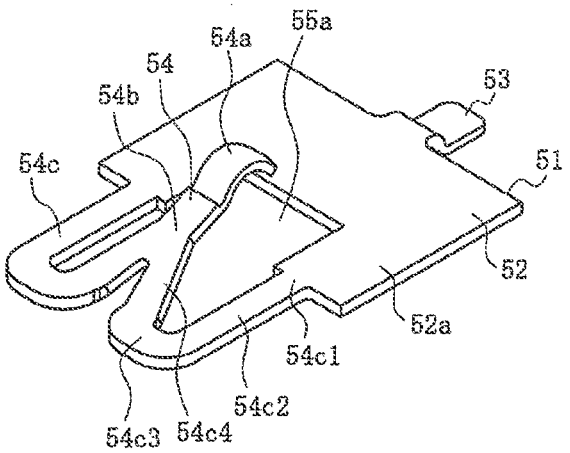
Figure 10C:
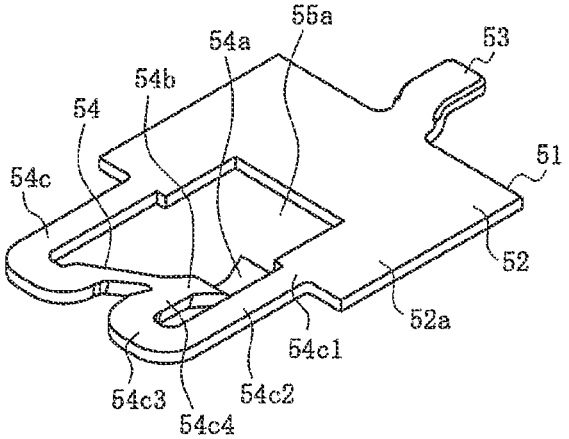
Figure 11A:
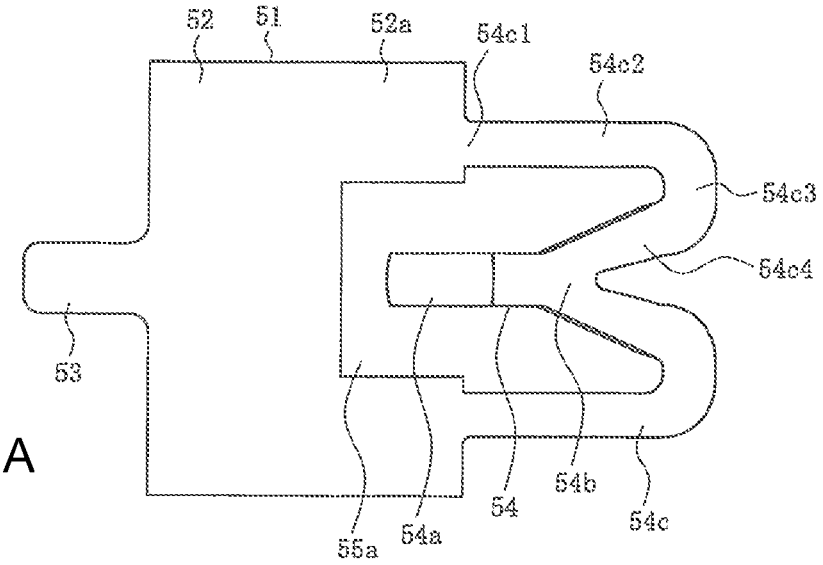
Figure 11B:
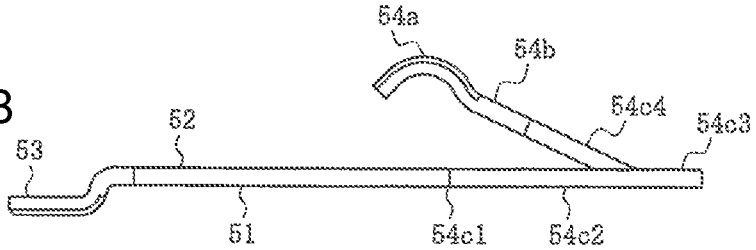
Figure 11C:
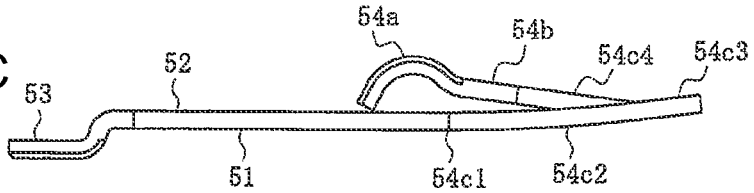
Figure 12:
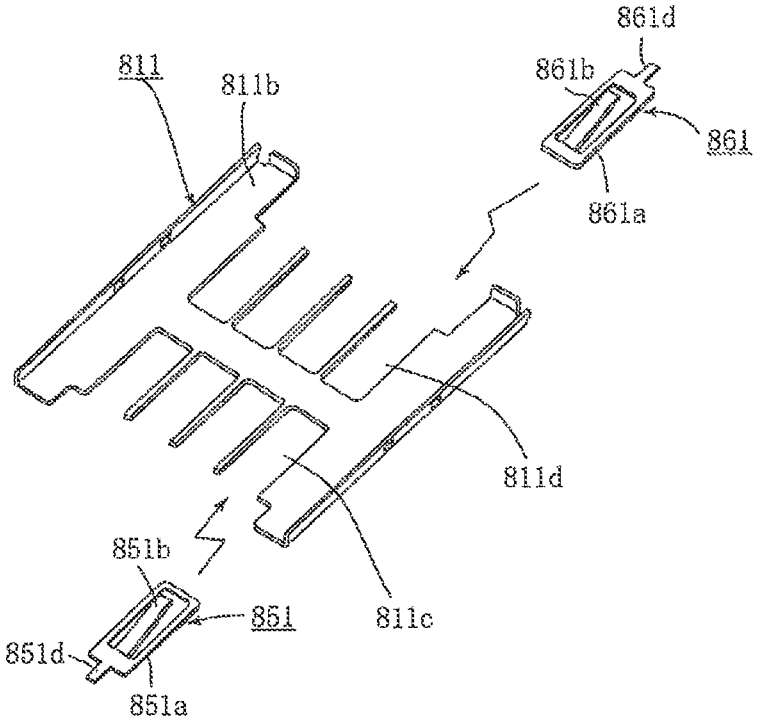
Prior art FIG. 12
FIG. 12 is a diagram showing a conventional connector for a card.

Each arm portion 54*c* of the contact member 54 has a root portion 54*c*1 connected to the connecting portion 52*a* of the base portion 52, and the upper arm portion 54*c*2, the curved portion 54*c*3 and the front arm portion 54*c*4 are elastically deformed. The joining portion 54*b* at the front end of the front arm portion 54*c*4 functions as a cantilevered spring portion elastically deformed in the vertical direction. The upper arm portion 54*c*2 and the front arm portion 54*c*4 are connected via the curved portion 54*c*3 and, as mentioned earlier, has a U- or J-shaped profile when viewed from above. Compared to the overall length of the contact member 54, the portion functioning as the cantilevered spring portion is fairly long, extending the spring length. As shown in FIGS. 6A and 8A, the length from the root portion 54*c*1 to the joining portion 54*b* along the center line of the contact member 54 is greater than the length from the root portion 54*c*1 to the curved portion 54*c*3 (from the left to the right in FIGS. 6A and 8A). Because the spring length of the contact member 54 is sufficient, the contact portion 54*a* on the leading end is displaced significantly in the vertical direction. Therefore, as shown in FIG. 9, the contact portion 54*a* is displaced along the entire vertical range towards a contact pad 151 on a card 101 inserted into the card connector 1, and reliable contact can be maintained with the contact pad 151.

Because the arm portions 54*c* functioning as the cantilevered spring portions are divided on the left and right, the width of each arm portion 54*c* can be narrowed. This increases the resiliency of the spring portions. The contact portion 54*a* can be resiliently displaced in the vertical direction, and be resiliently displaced far enough in the vertical direction to reach the contact pad 151 and make more reliable contact with the contact pad 151.

Figure 6C:
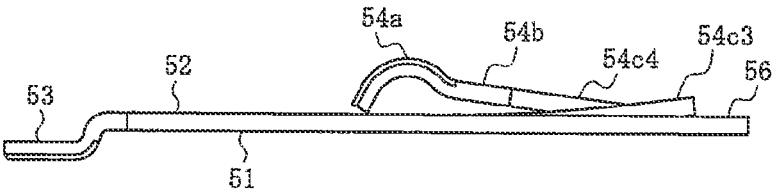
Figure 7A:
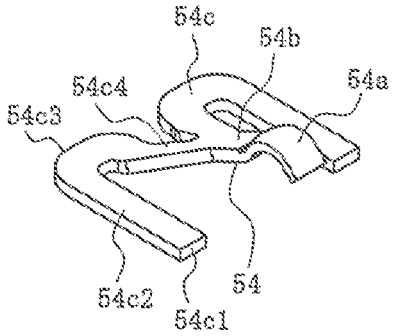
Figure 7B:
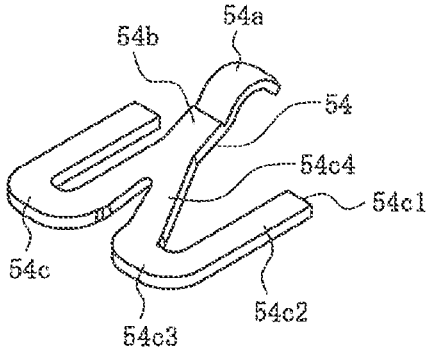
Figure 7C:
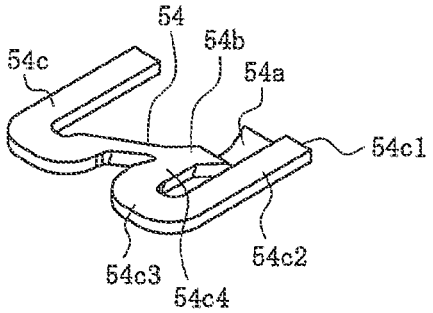
Figure 8C:
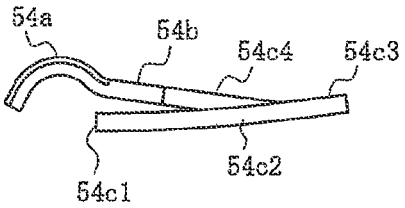

The width and thickness of the upper arm portion 54*c*2, curved portion 54*c*3 and front arm portion 54*c*4 are fixed along the entire length of each arm portion 54*c*. Therefore, the entire length from the root portion 54*c*1 to the joining portion 54*b* is uniformly displaced and functions as the spring portion. In other words, there is no portion that does not function as a spring portion. Some portions are slightly displaced and others are displaced by a greater amount, and there are no portions that are plastically deformed. In order to provide greater clarity, the displacement of the arm portion 54*c* shown in FIGS. 6C and 8C will be compared to the displacement of the same portion in FIGS. 6B and 8B. In FIGS. 6C and 8C, the curved portion 54*c*3 is raised higher than in FIGS. 6B and 8B. Therefore, the entire length from the root portion 54*c*1 to the joining portion 54*b*, including the upper arm portion 54*c*2, is uniformly displaced. Because the entire length from the root portion 54*c*1 to the joining portion 54*b* is uniformly displaced and functions as a spring portion. As a result, the contact portion 54*a* is elastically displaced in the vertical direction, and contact with the contact pad 151 can be reliably maintained.

The two arm portions 54*c* functioning as cantilevered plate springs are integrated by the joining portion 54*b*, and the spring action applied by the contact portion 54*a* is twice the spring action of the individual arm portions 54*c*. As a result, the greater spring action presses the contact portion 54*a* against the contact pad 151, increasing the contact pressure and more reliably maintaining contact with the contact pad 151.

Because, as mentioned earlier, the spring length is greater relative to the entire length of the contact member 54, the overall length of the contact member 54 can be reduced. Thus, the length from the rear end of the terminal 51 to the contact portion 54*a* can be reduced. Therefore, if the rear terminal holding recessed portion 11*c* is formed near the rear edge of the housing 11 as shown in FIG. 9, the length from the rear edge 11*r* to the contact portion 54*a* can be reduced, and the rear end 111*r* of the card 101 does not have to be inserted forward very far from the rear edge 11*r* when the card 101 is inserted into the card connector 1, even when the distance from the rear end 111*r* of the card 101 to the contact pad 151 near the rear end 111*r* is short. Because at least the contact portion 54*a* of the contact member 54 is positioned inside the central opening 55*a* when viewed from above, and the base portion 52 and the bottom wall portion 11*b* are not below the contact portion 54*a*, the contact portion 54*a* can be elastically deformed downward in a wider range, and can reliably maintain contact with a contact pad 151 on the inserted card 101.

In operation, the card 101 is inserted into the card insertion space formed between the housing 11 and the shell 71 from the insertion slot 18 to the rear of the card connector 1. The card 101 is inserted with the front end 111*f* facing the front edge 11*f* of the housing 11, the bottom face 111*a* facing the bottom wall portion 11*b*, and the top face 111*b* facing the ceiling plate portion 72 of the shell 71. In this way, the card 101 is inserted so the side edge 112 without the notched portion 111*b* travels along the card guiding mechanism accommodating portion 11*h*.

Next, when the card 101 is pushed in, the side edge holding portion 23*b* and the front end holding portion 23*c* of the sliding member 23 hold the side edge 112 and the front end 111*f* of the card 101. As a result, the card 101 is held by the sliding member 23, and moves along with the sliding member 23 towards the inner wall portion 11*a*. At this time, the pressing force is transmitted from the front end 111*f* of the card 101 to the sliding member 23 via the front end holding portion 23*c*. Because the sliding member 23 compresses the biasing member 82, which is a coil spring, the rebound force of the biasing member 82 is received by the sliding member 23 and the card 101. However, the rebound force is lower than the pressing force, so the rebound force is resisted and movement continues. At this time, the sliding member 23 slides along the card guiding mechanism accommodating portion 11*h*, and the card 101 moves along with the sliding member 23. The sliding member 23 and the card 101 reach the over stroke position, which is the forward most position, and are in an over stroke state.

Next, when the push of the card 101 is stopped and the pressure is released on the card 101, the rebound force of the biasing member 82 moves the sliding member 23 and the card 101 backwards away from the inner wall portion 11*a*. Next, the sliding member 23 and the card 101 stop at the locked position where they are held in a locked state. The free end of the pin member 81 engaged with the cam groove 22 formed in the top face of the sliding cam portion 21 is locked by a portion of the cam groove 22. This stops movement of the sliding member 23, and the sliding member 23 stops at the locked position.

When the card 101 is held in the locked position, the reading and writing of data can be performed by the computing means of the electronic device mounted in the card connector 1. When the card 101 is held in the locked position, the state shown in FIG. 9 is maintained, and the contact portions 54*a* of the terminals 51 of the card connector 1 remain in electrical contact with the contact pads 151 of the card 101. However, when the card 101 is pushed a second time, the rear end 111*r* of the card 101 is pushed in. If the bottom wall portion 11*b* of the housing 11 extends in the longitudinal direction and the rear edge 11*r* is positioned to the rear of the rear end 111*r* of the card 101, and the card 101 is pushed forward beyond the locked position to the over stroke position, the rear edge 11*r* of the housing 11 makes it impossible to push any further. In other words, the push operation can no longer be performed. In the card connector 1 of the Present Disclosure, as mentioned earlier, the distance from the rear edge 11*r* to the contact portion 54*a* of the terminal 51 in the rear terminal holding recessed portion 11*c* is shorter. Therefore, even though the distance from the rear end 111*r* of the card 101 to the contact pad 151 near the rear end 111*r* is short, the rear end 111*r* of the card 101 does not have to be pushed forward very far from the rear edge 11*r*. As a result, operability is not reduced.

To eject the card 101 from the card connector 1, which occurs when the card 101 is pushed, the sliding member 23 and the card 101 move from the locked position towards the inner wall portion 11*a*. When the pushing of the card 101 continues, the sliding member 23 and the card 101 move to the over stroke position, which is the forward most position, and enter an over stroke state. Next, when the pushing of the card 101 is stopped and the pushing force applied to the card 101 is released, the rebound force of the biasing member 82 moves the sliding member 23 and the card 101 in the over stroke position away from the inner wall portion 11*a* in the opposite direction. The sliding member 23 and the card 101 move to the rear beyond the locked position and the card 101 is ejected from the slot 18.

In the explanation of the present embodiment, the terminals 51 were accommodated in the front terminal holding recessed portion 11*d* and the rear terminal holding recessed portion 11*c*. However, the configuration of the terminals accommodated in the front terminal holding recessed portion 11*d* can differ from that of the terminals 51. For example, the contact member of the terminals accommodated in the front terminal holding recessed portion 11*d* does not have to have the M-shaped or W-shaped profile of the contact member 54 of the terminals 51. It can instead have a simple cantilevered shape extending in a linear direction as explained earlier in the background art section. This is because the front terminal holding recessed portion 11*d* is farther away from the rear edge 11*r*, and contact members that are longer in the longitudinal direction do not obstruct anything.

In the present embodiment, the card connector 1 has a housing 11 for accommodating a card 101 with contact pads 151, and terminals 51 mounted in the housing 11 for making contact with the contact pads 151 on the card 101. At least one of the terminals 51 is arranged along the rear edge 11*r* of the housing 11, and has a base portion 52 at least partially embedded in the bottom wall portion 11*b* of the housing 11, and a contact member 54 forming a hoop with the base portion 52. The contact member 54 has a pair of arm portions 54*c* connected to the base portion 52, a joining portion 54*b* joining the pair of arm portions 54*c*, and a contact portion 54*a* connected to the leading end of the joining portion 54*b* for establishing contact with a contact pad 151 on the card 101.

In this way, the card connector 1 can have contact portions 54*a* positioned on the leading end of the contact members 54 near the rear edge 11*r* of the housing 11 while maintaining a sufficient spring length for the terminals 51. This makes it easier to insert and eject a card 101 with contact pads 151 on the rear end 111*r*, and can improve reliability. Because the contact pressure is good, contact can be reliably maintained between the contact portions 54*a* and the contact pads 151. In addition, the contact members 54 have an M-shaped or W-shaped profile when viewed from above. In this way, the contact portions 54*a* can be positioned near the rear edge 11*r* of the housing 11 while retaining resilient arm portions 54*c* of sufficient length. Further, the leading end of the joining portion 54*b* extends upward at an angle towards the front edge 11*f* of the housing 11, and the contact portion 54*a* is positioned in the central opening 55*a* inside a hoop when viewed from above. In this way, the contact portion 54*a* can be elastically displaced in a vertical direction without being constrained or interfered with by the other members.

Each arm portion 54*c* has an upper arm portion 54*c*2 extending from the base portion 52 towards the rear edge 11*r* of the housing 11, a curved portion 54*c*3 connected on one end to the upper arm portion 54*c*2, and a front arm portion 54*c*4 connected to the other end of the curved portion 54*c*3 and extending towards the front edge 11*f* of the housing 11. The leading end of the front arm portion 54*c*4 is joined with the joining portion 54*b*. In this way, the contact portion 54*a* connected to the leading end of the joining portion 54*b* can be displaced significantly in the vertical direction because the spring length of the arm portion 54*c* is sufficient. This provides enough displacement in the vertical direction to allow for contact with a contact pad 151 on the card 101. Each arm portion 54*c* has a fixed width and thickness along its entire length, and functions as a cantilevered plate spring. Because each arm portion 54*c* is uniformly displaced along its entire length and functions as a plate spring, the contact portion 54*a* connected to the leading end of the joining portion 54*b* is sufficiently displaced in the vertical direction, and contact can be more reliably maintained with a contact pad 151.

The housing 11 has a rear terminal holding recessed portion 11*c* arranged along the rear edge 11*r* and passing through the lower wall portion 11*b*, and a terminal 51 arranged along the rear edge 11*r* of the housing 11 is held inside the rear terminal holding recessed portion 11*c* so the contact member 54 does not come into contact with the bottom wall portion 11*b*. In this way, the arm portions 54*c* can be freely displaced elastically, and the contact portion 54*a* can be elastically displaced in a wide range in the vertical direction. As a result, contact can be reliably maintained with a contact pad 151 on the inserted card 101. The rear terminal holding recessed portion 11*c* can be formed near the rear edge 11*r* of the housing 11, and the terminals 51 can be arranged near the rear edge 11*r*. Therefore, the distance from the rear edge 11*r* to the contact portion 54*a* can be reduced, and the rear end 111*r* of the card 101 does not have to be inserted very far beyond the rear edge 11*r* when the card 101 is inserted into the card connector 1 even though the distance from the rear end 111*r* of the card 101 to the contact pad 151 near the rear end 111*r* is short. This improves operability.

FIGS. 10A-10C and 11A-11C illustrate a second embodiment of the Present Disclosure. As shown, the terminals 51 in the present embodiment do not have a frame member 56 surrounding the contact member 54. In other words, the frame member 56 has been omitted from the terminal 51 in the first embodiment. In all other respects, the terminal 51 has the same configuration as the first embodiment. Because these elements of the card connector 1 are identical to those in the first embodiment, further explanation has been omitted.

Because the terminals 51 in the present embodiment do not have a frame member 56, the distance from the rear edge 11*r* of the housing 11 to the contact portion 54*a* of the terminal 51 is shorter than that of the first embodiment by the amount of space occupied by the frame member 56. Therefore, when the card 101 has been moved forward to the over stroke position, the rear end 111*r* of the card 101 does not have to be inserted very far beyond the rear edge 11*r* even though the distance from the rear end 111*r* of the card 101 to the contact pad 151 near the rear end 111*r* is short. This reliably prevents any decrease in operability. Because the other effects are identical to those of the first embodiment, further explanation has been omitted.

While a preferred embodiment of the Present Disclosure is shown and described, it is envisioned that those skilled in the art may devise various modifications without departing from the spirit and scope of the foregoing Description and the appended Claims.

What is claimed is:

1. A conductive connecting terminal, the terminal comprising:

a base portion, the base portion having first and second forward connection;

a contact member, the contact member cooperating with the base portion to form a hoop to define a central opening, the hoop including first and second spring portions and a joining portion, the first and second spring portions each having first and second ends, the first end of the first spring portion being connected to the first forward connection portion of the base portion, the first end of the second spring portion being connected to the second forward connection portion of the base portion, the second ends of the first and second spring portions being connected to the joining portion, the contact member further including a contact portion which is connected to the joining portion; and a frame member, the frame member having first and second ends, the first end of the frame member being connected to the first forward connection portion of the base portion, the second end of the frame member being connected to the second forward connection portion of the base portion, the frame member extending generally around the contact member to define a peripheral open portion between the frame member and the contact member.

2. The conducting connecting terminal according to claim 1, wherein the hoop comprises an M-shaped profile when viewed from above.

3. The conducting connecting terminal according to claim 2, wherein the end of the joining portion extends toward the base portion, and the contact portion is positioned inside the central opening when viewed from above.

4. The conducting connecting terminal according to claim 1, wherein the hoop and comprises a W-shaped profile when viewed from above.

5. The conducting connecting terminal according to claim 4, wherein the end of the joining portion extends toward the base portion, and the contact portion is positioned inside the central opening when viewed from above.

6. The conducting connecting terminal according to claim 1, wherein the joining portion extends from the second ends of the first and second spring portions toward the base portion, and the contact portion is positioned inside the central opening when viewed from above.

7. The conducting connecting terminal according to claim 1, wherein each spring portion includes a first portion extending from the base portion in a first direction, a curved second portion having an end connected to the first portion, and a third portion connected to the other end of the second portion and extending in a second direction, generally opposite the first direction, the leading end of the third portion being joined to the joining portion.

8. The conducting connecting terminal according to claim 1, wherein each of the spring portions has a fixed width and thickness along its entire length, and functions as a cantilevered spring.

9. The conducting connecting terminal according to claim 1, wherein the base portion has a rearward connection portion, and further comprising a solder tail portion, the solder tail portion being connected to the rearward connection portion of the base portion.

10. The conducting connecting terminal according to claim 9, wherein the solder tail portion extends in a direction opposite from the first and second spring portions.

11. The conducting connecting terminal according to claim 9, wherein the base portion is planar, and wherein the contact portion is positioned above the planar base portion, and wherein a free end of the solder tail portion is positioned below the planar base portion.

* * * * *